US005177415A

United States Patent [19]

Quibel et al.

[11] Patent Number: 5,177,415

[45] Date of Patent: Jan. 5, 1993

[54] APPARATUS AND METHOD FOR CONTROLLING A VIBRATORY TOOL

[75] Inventors: Alain J. Quibel, Saint Etienne Du Rouvray; Michel M. Aubourg, Senlis; Michel H. Froumentin, Isneauville; René G. Divay, Clermont, all of France

[73] Assignee: Caterpillar Paving Products Inc., Minneapolis, Minn.

[21] Appl. No.: 608,089

[22] Filed: Nov. 1, 1990

[51] Int. Cl.[5] ..... B64C 17/02

[52] U.S. Cl. ..... 318/128; 318/648; 404/117; 73/573; 364/551

[58] Field of Search ..... 318/139, 128, 560–640; 51/163.1, 163.2; 404/103, 117, 123, 133.05; 73/573, 78, 84, 82; 180/20, 21; 364/551, 500, 155, 154, 505

[56] References Cited

U.S. PATENT DOCUMENTS

| | | | |
|---|---|---|---|
| Re. 31,195 | 4/1983 | Thurner | 73/573 |
| 3,599,543 | 8/1971 | Kerridge | 94/50 |
| 3,797,954 | 3/1974 | Harris | 404/117 |
| 3,870,226 | 3/1975 | Leroy | 364/511 |
| 4,149,253 | 4/1979 | Paar et al. | 404/117 X |
| 4,212,071 | 7/1980 | Dortu | 364/505 |
| 4,330,738 | 5/1982 | Paramythioti et al. | 318/128 |
| 4,348,901 | 9/1982 | Vural et al. | 73/594 |
| 4,467,652 | 8/1984 | Thurner AB et al. | 73/573 |
| 4,546,425 | 10/1985 | Breitholtz | 364/551 X |
| 4,734,846 | 3/1988 | Konig | 73/573 X |
| 4,870,601 | 9/1989 | Sandstrom | 404/117 X |

*Primary Examiner*—Paul Ip
*Attorney, Agent, or Firm*—Robert A. McFall

[57] ABSTRACT

An apparatus 400 and a method are provided for increasing the density of a compactible material 10 while continuously evaluating the density of the material. The evaluation of material density is carried out by calculating the total of the static, dynamic and centrifugal forces applied by a vibrating tool 102 l to the compactible material 10. The total applied force calculation includes measuring the vertical acceleration of the material contacting member 102 and the position of an eccentric mass 206 mounted on the material contacting member 102. The acquisition of these parameters is carried out simultaneously, and the calculation of the dynamic and centrifugal forces is made when the material contacting member 102 is at its lowest position.

15 Claims, 13 Drawing Sheets

802
FIRST PASSAGE ?
N
Y
804
SET DISTANCE = 0
806
INITIALIZE REAL TIME CYCLE
724
A
808
HOMOGENEITY SELECTED ?
N
Y
812
DISPLAY INSTANTANEOUS INFORMATION
810
DISPLAY DISTANCE AND TAF

APPARATUS AND METHOD FOR CONTROLLING A VIBRATORY TOOL

TECHNICAL FIELD

This invention relates generally to an apparatus and method for controlling the operation of a vibratory tool and more particularly to an apparatus and method for continuously evaluating the density of material compacted by the vibrating tool.

BACKGROUND ART

It has been a long sought after goal to control the compaction of soil, road base, bituminous and similar materials by a vibratory compactor so that the desired material density is achieved in as few passes by the compactor as possible. Often, to assure adequate compaction, a compactor operator continues to work the material after it has achieved the desired density, which may over compact the material. This practice is wasteful of both time and equipment. It has also been recognized that it would be highly desirable to continuously monitor compaction operations, while they are being performed, to assure that the required material density is being achieved uniformly across the entire work area.

Several devices, using one or more parameters relating to a characteristic of soil density, have been proposed for controlling the vibratory compaction of soil and roadway materials. For example, West German Patent No. 2,942,334 issued Jun. 28, 1984 to Koehring Bomag GMBH describes an apparatus for monitoring the degree of compaction by measuring the value of an operating parameter, such as the hydraulic pressure in the vehicle drive system, and comparing the measured value with values measured during preceding passes of the vehicle.

Other devices measure selected physical characteristics of the vehicle which vary with the density of the compactible material. Kerridge U.S. Pat. No. 3,599,543 issued Aug. 17, 1971 compares the length of the major axis of the elliptical path of a point on the vehicle's vibrating roller with the length of the axis when the ground is fully compacted. Swedish Patent No. 76 08709, published Feb. 27, 1978 to Heinz Thurner measures the amplitude of the vertical motion of the vibrating roller at a fundamental frequency and at one or more harmonic frequencies, and calculates a ratio of the measured fundamental and harmonic frequencies. Swedish Patent No. 80 08299 published Jun. 28, 1982 to Geodynamic Thurner AB et al, relates the degree of compaction to the shape of a waveform representative of the vertical movement of the vibratory compactor.

The values of the parameters measured by the above described devices and methods are sensitive to the rotational frequency and mass of the eccentrically mounted member and, in some instances, to vehicle speed. Consequently, in order to obtain comparable data, i.e., data that can be directly correlated with previously or subsequently recorded data, or with other predetermined values to evaluate the present degree of compaction, the frequency and mass of the eccentrically mounted member, the vehicle speed and other such operating conditions that influence the value of the measured parameter must be maintained uniformly throughout a particular compaction operation.

This requirement often prevents use of a vibratory compactor in the most efficient manner. It is often desirable to change the ground speed of the vehicle, or the mass or frequency of the eccentrically mounted rotating member during a specific compaction operation. For example, the resonant frequency, i.e., the frequency at which the amplitude of the material contacting tool, or drum, has a maximum value, is influenced by material density. Adjustment of the rotational frequency of the eccentrically mounted mass to maintain operation at the resonant frequency throughout the compaction operation is therefore desirable. The frequency adjustment may be carried out automatically by a closed loop system, or manually by an operator. Examples of frequency control systems based on the angular relationship of the respective positions of the rotating eccentric mass and the vibrating drum are described in French Patent No. 2,390,546 issued Jan. 12, 1979 to Albaret S. A. and in Jesse W. Harris U.S. Pat. No. 3,797,954 issued Mar. 19, 1974.

Thus, material density correlating devices and methods, such as those described above, which rely on the value of measured parameters which are sensitive to changes in operating conditions, are unsuitable for use in compacting operations in which it is desirable to vary the operating characteristics of the vehicle.

Furthermore, the sensitivity of density correlation methods based on some resonant property of the physical system comprising the vibratory vehicle and the compactible material, such as the devices and methods described above, decreases as material density increases. Therefore, it becomes increasingly difficult to detect small changes in the density of the compactible material as the amount of compaction approaches the desired value. This characteristic, when combined with the requirement to maintain uniform operation of the vehicle throughout the compacting operation, makes the above devices impractical to use.

The present invention is directed to overcoming the problems set forth above. It is desirable to have an apparatus for increasing the density of a compactible material that is able to continuously and accurately evaluate the increase in material density. It is also desirable to have a method for continuously evaluating material density that is particularly sensitive to small changes in density as the material density approaches the desired value.

By way of comparison, a number of tests were made at the Centre d'Experimentations Routières, Rouen, France, comparing currently used density correlation methods with the method of the present invention. The tests were all carried out by the same vibratory compactor on crushed gravel material designated in French Listes d'Aptitude as Material D3. This material, a material commonly used in road and highway construction, is considered to be very difficult to compact. The density of the D3 material was measured after the 2nd, 10th, 20th, 30th and 64th pass over the material by the vibratory compactor. The percent change of the measured parameters of the vibratory compactor was also calculated after the same number of passes over the material. The parameters measured were the hydraulic pressure in the vehicle drive circuit, the vertical acceleration of the drum, the harmonic ratio of the vertical acceleration of the drum, and the harmonic ratio of the vertical amplitude of the drum. In addition, the values determined by the method of the present invention which continuously calculates the total force applied by the material contacting member is identified as TAF (Total Applied Force) in the following table.

| PERCENT CHANGE OF MEASURED OR CALCULATED PARAMETER COMPARED TO ACTUAL PERCENT CHANGE OF SOIL DENSITY | | | | |
|---|---|---|---|---|
| | NUMBER OF PASSES | | | |
| PARAMETER | 2 → 10 | 2 → 20 | 2 → 30 | 2 → 64 |
| Actual Density | +3.3% | +4.73% | +5.57% | +7.10% |
| Hydraulic Pressure Propel Circuit | −17.5% | −25.2% | −29.7% | −38.0% |
| Vertical Acceleration (Drum) | +11.6% | +16.5% | +19.5% | +24.9% |
| Harmonic Ratio Vertical Acceleration | +16.8% | +24.0% | +28.3% | +36.2% |
| Harmonic Ratio Amplitude | +21.0% | +30.2% | +35.5% | +36.2% |
| TAF (Total Applied Force) | +95.3% | +136.4% | +160.4% | +205.3% |

As can be seen, the parameter identified as TAF is particularly sensitive to small increases in material density.

DISCLOSURE OF THE INVENTION

In accordance with one aspect of the present invention, an apparatus for controlling a vibrating tool that is resiliently and rotatably mounted on a chassis and has an eccentrically mounted mass attached to a shaft rotatably mounted on the material contacting member, includes a means for producing a signal corresponding to the vibratory motion of the material contacting member, a means for producing a signal corresponding to the angular position of the eccentrically attached mass relative to a preselected position, a system for receiving the produced signals, calculating the static, dynamic and centrifugal forces applied by the material contacting member to the compactible material, and producing a signal correlative of the total of the static, dynamic and centrifugal forces.

Other features of the apparatus include a means for producing a signal corresponding to the vibratory motion of the chassis, and further, a means for automatically controlling the frequency of the eccentrically mounted rotating mass.

In another aspect of the present invention, a method for controlling a vibrating tool includes moving a chassis-mounted vibrating tool over a compactible material and maintaining the tool in substantial rolling contact with the material during movement thereover. A member, eccentrically attached to a rotatable shaft mounted on the vibrating tool, is rotated simultaneously with the movement of the vibrating tool over the compactible material, and the maximum value of the vertical acceleration of the vibrating tool during one rotation of the eccentrically attached member is determined. A signal corresponding to the thus determined maximum value of the vertical acceleration of the vibrating tool is produced. The presence of the rotating eccentric mass at a predetermined reference position is also sensed and the angular position of the rotating eccentric mass when the vertical acceleration of the vibrating tool is at the maximum value is calculated. A signal representative of the angular displacement between the calculated and reference positions of the rotating eccentrically mounted mass is produced. Signals representative of the mass of the chassis and of the vibrating tool mounted on the chassis are also produced. The produced signals are received and the static, dynamic and centrifugal forces applied by the vibrating tool to the compactible material are calculated. A signal representative of the value of the sum of the static, dynamic and centrifugal forces thus calculated is produced. Movement of the vibratory tool over the compactible material is stopped when the value of the sum, or total, of the static, dynamic and centrifugal forces is at a predetermined value.

Other features of the method include producing a signal corresponding to the vertical acceleration of the chassis when the vertical acceleration of the vibrating tool is at the maximum value, and further, visually displaying the value of the sum of the static, dynamic and centrifugal forces applied by the vibrating tool to the compacted material.

BEST MODE FOR CARRYING OUT THE INVENTION

Figure 1:
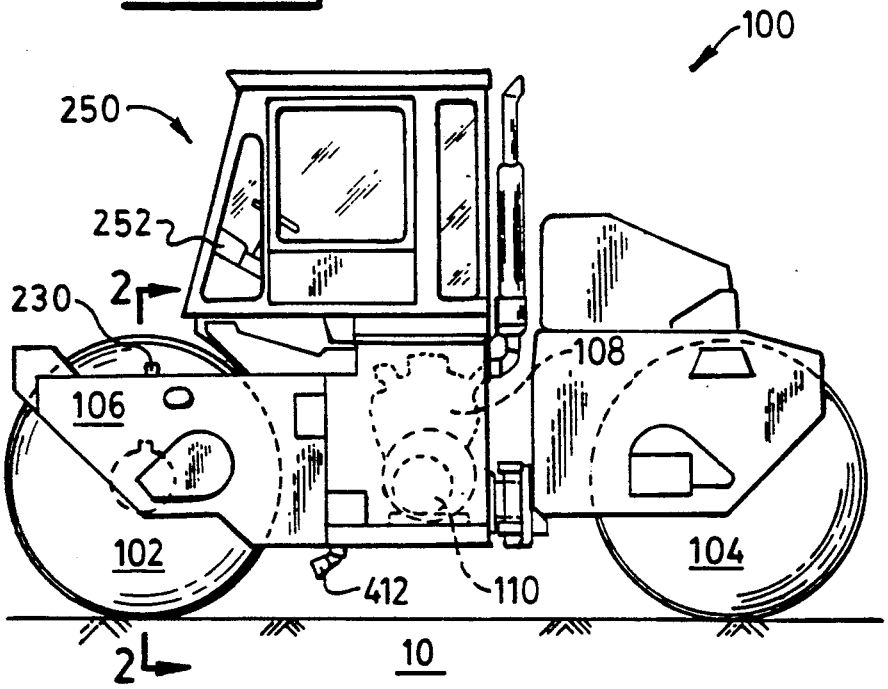
FIG. 1 is a side view of a vibratory compactor embodying the present invention.
Figure 2:
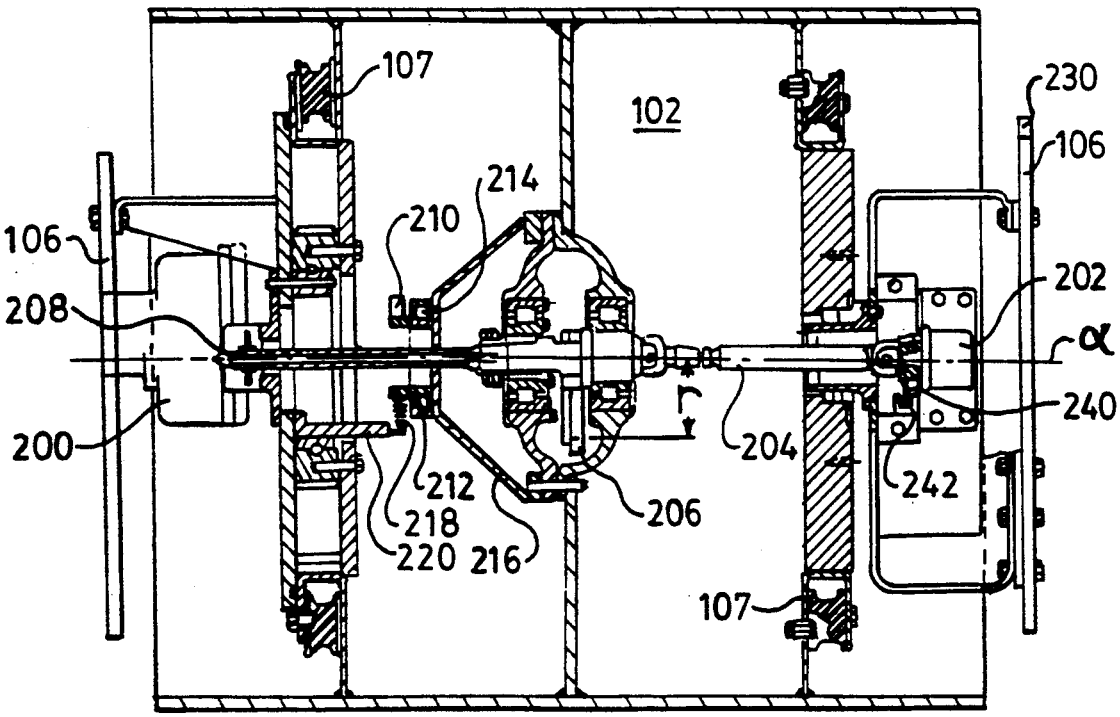
FIG. 2 is a sectional of the vibratory compactor taken along the line 2—2 of FIG. 1.

A Vibrating tool (compactor) 100 for increasing the density of a compactible material 10, such as soil, crushed gravel, bituminous mixtures and similar materials, includes a pair of material contacting members 102,104. The material contacting members 102, 104 are typically smooth steel drums that are rotatably mounted on a chassis 106 of the compactor 100. As shown in FIG. 2, the drums 102,104 are vibrationally isolated from the chassis 106 by a plurality of rubber or elastomeric mounting blocks 107.

The vibratory compactor 100 includes an engine 108 driving a hydraulic pump 110 that is operatively connected by hoses or other conduits, not shown, to hydraulic motors driven by pressurized hydraulic fluid provided by the pump 110. For example, a hydraulic motor 200 is attached to a forward portion of the chassis 106 and drives the forward drum 102. A second chassis-mounted hydraulic motor 202 is attached to a shaft 204 that is rotatably mounted on the drum 102.

The compactor 100 further includes a member 206 eccentrically attached to the rotatable shaft 204. Preferably, the eccentrically attached member 206, alternatively referred to hereinafter as an eccentric mass, eccentric, or eccentrically loaded rotary shaft, comprises two sections having different masses whose respective radial positions can be adjusted by a control rod 208. When the two sections are radially offset 180° with respect to each other, the net eccentric mass is at a minimum value. If the two sections are aligned at the same radial position, the net eccentric mass has a maximum value. Aligning the two sections at an intermediate angle with respect to each other will provide a net eccentric mass having a value between the minimum and maximum values. Thus, three values for the mass of the eccentrically attached member 206, and accordingly three vibratory energy levels, can be provided by the respective position of the control rod 208. Alternatively, the respective positions of the two sections may be controllably shifted automatically to provide a continuous range of values for the mass of the eccentrically attached member 206.

The eccentrically attached member 206 is rotated by the hydraulic motor 202 about an axis $\alpha$, which corresponds with the axis of the shaft 204. The distance between the center of gravity of the eccentrically attached member 206 and the center of rotation $\alpha$ of the shaft 204 represents the radius of rotation of the gravitational center of the eccentrically attached member 206, and is indicated in FIG. 2 by the letter r. When the eccentrically attached member 206 is rotated, unbalanced forces are transferred to the drum 102 thereby imparting a vibratory movement to the drum 102. The drum 104 is resiliently mounted on the chassis 106, in a manner similar to the drum 102, and also has hydraulic motors and an eccentrically loaded rotary shaft mounted thereon.

An accelerometer 210 is mounted on a nonrotating element of the drum 102. In the preferred embodiment of the present invention, the accelerometer 210 is mounted on a ring 212 that is connected, by way of a bearing element 214, to a housing 216 of the eccentrically attached member 206. Rotation of the ring 212 with respect to the chassis 106 is prevented by a pair of springs 218 that extend from respective opposite lateral sides of the ring 212 to a bracket 220. The bracket 220 is mounted on a non-rotating plate, attached to the chassis 106, which supports the drum drive motor 200. The eccentric 206 is therefore able to rotate independently of the ring 212. Also, in the preferred embodiment, a second accelerometer 230 is mounted on the chassis 106. The accelerometers 210,230, are preferably piezoelectric accelerometers having a frequency range of 1 to 5000 Hz and a sensitivity of 100 mV/g. Accelerometers having these characteristics are commercially available.

A radially extending tab 240 is mounted on the shaft 204 in radial alignment with the eccentrically attached member 206. A transducer 242 is mounted on a bracket attached to the chassis 106 at a position to sense the presence of the tab 240 as it rotates through a position at which it, and accordingly the radially aligned member 206, are oriented vertically at the bottom of their rotation cycle. The use of transducers to sense rotating members is well known in the art, and is not further discussed herein.

The compactor 100 also includes an operator's station 250. The operator's station has a control panel 252 that includes well known vehicle operation and monitoring controls in addition to the control, data entry and display devices associated with the present invention which will be described below in greater detail.

Figure 3:
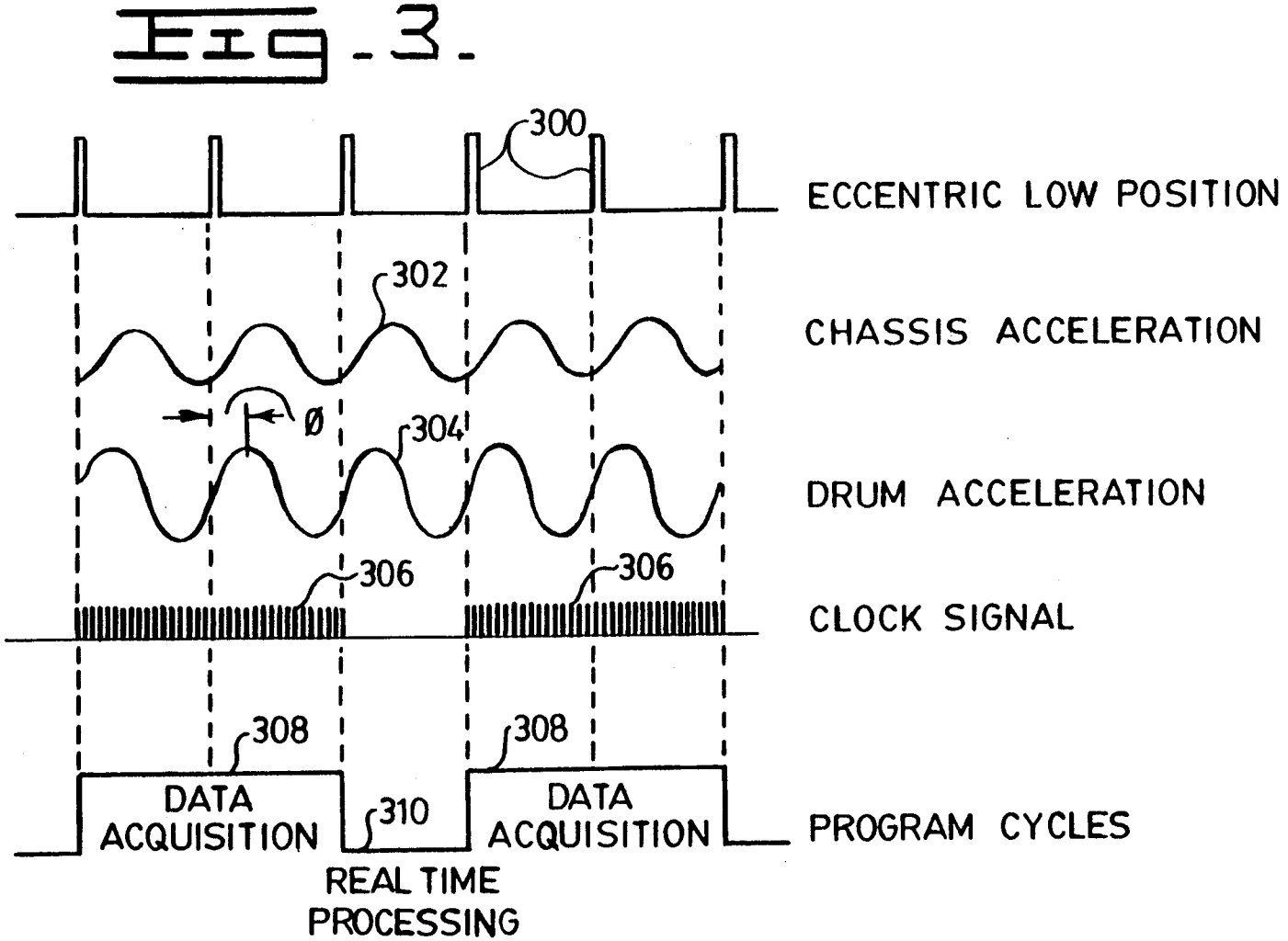
FIG. 3 is a graphical representation of signals representing parameters utilized during operation of the vibratory compactor embodying the present invention.

FIG. 3 illustrates, in graphic form, the relationship between the signals produced by the transducer 242, and the chassis and drum accelerometers 210,230. The transducer 242 provides a signal 300 having a characteristic pulse, or high value, indicative of the passage of the eccentric member 206 past the transducer 242. This signal therefore represents the vertically lowest position of the eccentrically attached member 206. The chassis and drum accelerometers 210,230 respectively provide signals 302 and 304 which are substantially sinusoidal and represent, respectively, the acceleration of the chassis 106 and the drum 102. As will be described below in more detail, a clock provides a timing signal 306 during a data acquisition period 308, which comprises two consecutive rotations of the eccentrically attached member 206. During the third rotation of the member 206 a real time procession period 310 occurs, during which calculations are made.

SYSTEM BLOCK DIAGRAM

Figure 4:
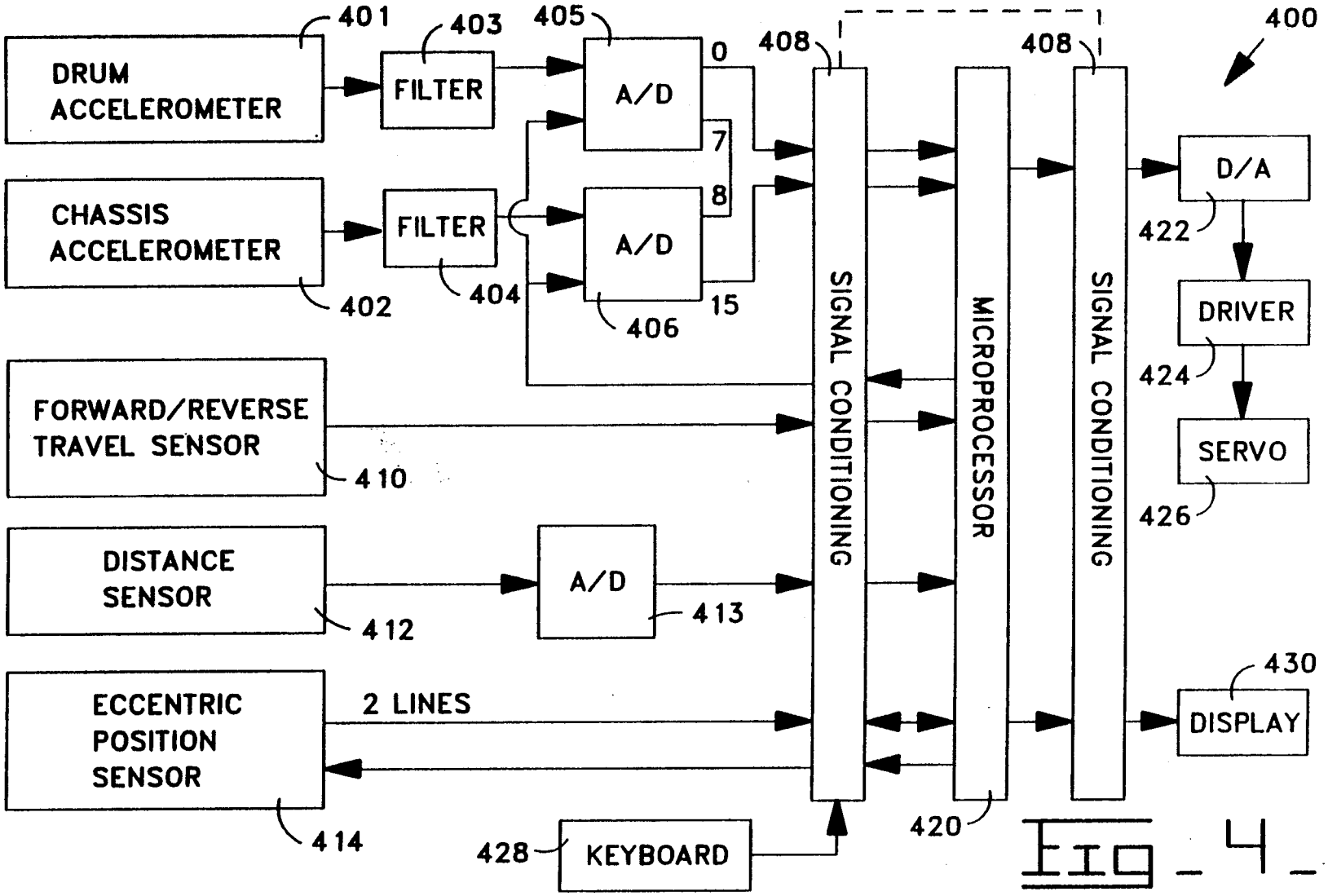
FIG. 4 is a block diagram of the major components of the apparatus for controlling a vibrating tool that embodies the present invention.

FIG. 4 illustrates in block form the major components of an apparatus 400 for controlling the operation of the vibrating tool 100. Blocks 401 and 402 represent the drum and chassis accelerometers 210,230, respectively. As previously discussed, each of these is a piezoelectric accelerometer that produces analog signals which are delivered to respective filters 403, 404. These filters perform initial conditioning of the signals and, in the preferred embodiment, are sixth order Butterworth filters that are commercially available from the National Semiconductor Corporation. Each of the filtered accelerometer signals is the n delivered to a respective analog to digital (A/D) converter 405,406. The converters 405,406 accept the analog input signals and transform the m into representative eight-bit digital signals. Because it is desirable that the drum and chassis accelerometer signals be acquired during the same time period by the control system, the A/D converters 405,406 are selected through a single address line. The output signals from the A/D converters 405,406 are provided to a signal conditioning circuit 408 via a 16 bit bus. In the preferred embodiment, the signals delivered to the signal conditioning circuit 408 are voltage signals in the range between negative 5 and positive 5 volts.

A forward/reverse travel sensor 410 also delivers digital signals to the signal conditioning circuit 408 in response to the direction of travel of the vehicle drum. A distance sensor 412, for example, a non-contacting transducer such as a radar or sonar device, delivers analog signals to an A/D converter 413, which in turn provides distance related digital signals to the signal conditioning circuit 408. Finally, the eccentric position sensor in block 414, delivers signals relating to the angular position of the eccentric mass 206 rotating within the vehicle drum 102 to the signal conditioning circuit 408. The eccentric position sensor 414 is discussed in further detail below. The signal conditioning circuit 408 provides an electrical interface between various peripheral devices such as those just described and a microprocessor 420. Communications occur directly between the signal conditioning circuit 408 and the microprocessor 420.

The microprocessor 420 delivers an output signal to a digital to analog (D/A) converter 422. This digital signal is converted by the D/A converter 422 into an analog signal which is supplied through a driver circuit 424 to a servo valve 426. The servo valve 426 regulates oil flow in the hydraulic motor 202 driving the eccentric mass 206 and causes the speed of the eccentric mass to vary in accordance with the signal delivered from the microprocessor 420. This control is bidirectional, depending on the direction of rotation chosen by the operator of the vehicle.

The control system 400 includes a keyboard 428 and display 430 mounted on the control panel 252 and connected through the signal conditioning circuit 408 to the microprocessor 420. The keyboard 428 is used to communicate with the control system 400, and the display 430 is used to supply information to the vehicle operator.

Figure 5:
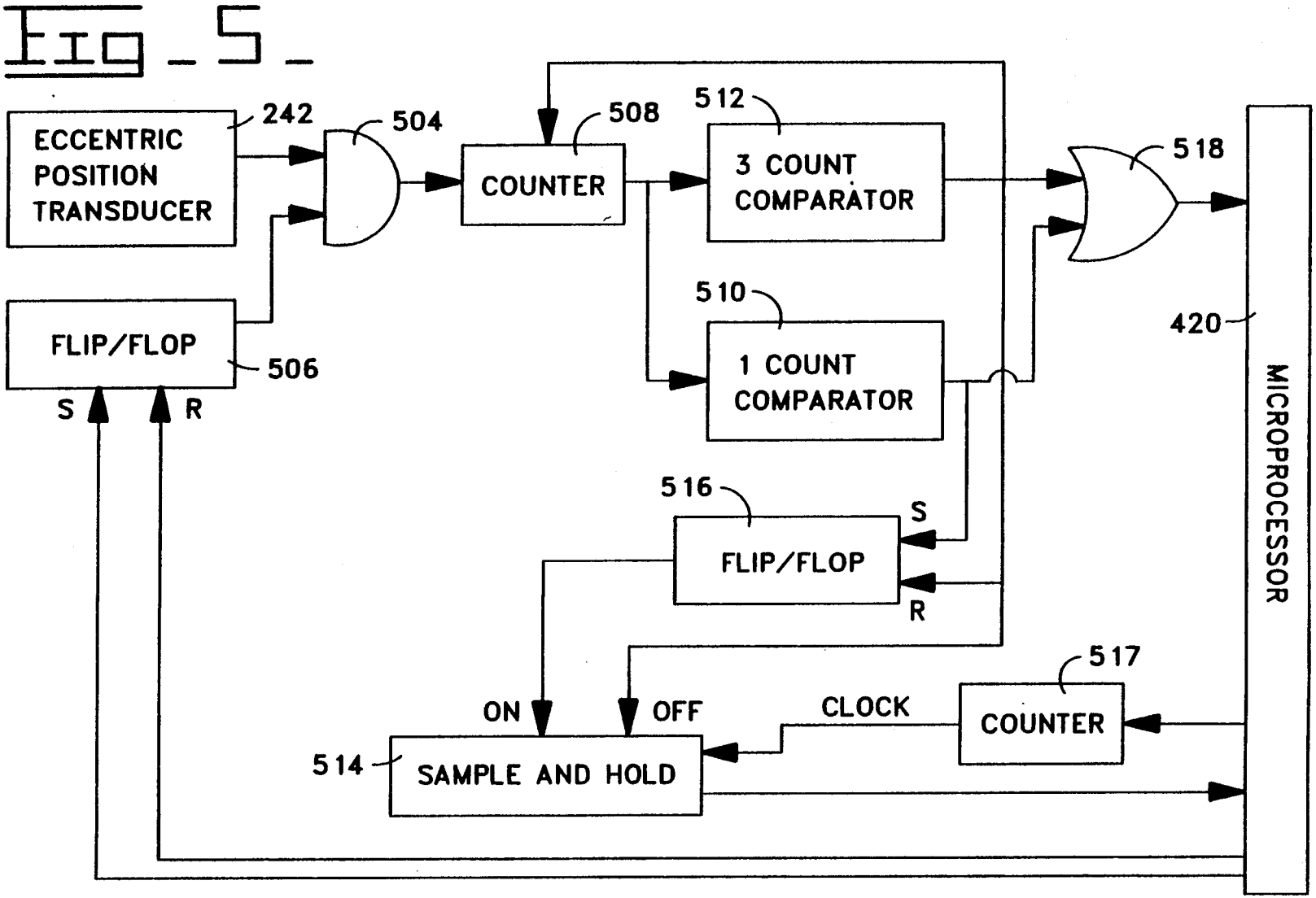
FIG. 5 is a block diagram of a circuit for determining the relative position of an eccentrically attached member rotatably mounted on the vibratory compactor embodying the present invention.

FIG. 5 illustrates in some detail a block diagram of the eccentric position sensor 414. The eccentric position transducer 242 produces the signal 300, which includes an electrical pulse each time the eccentric mass 206 rotates through a position at which it is oriented perpendicular to the ground surface, substantially at the bottom of its rotation cycle. At this point, the compaction force exerted by the vehicle drum 102 is at a maximum value. All measurements made by the control system 400 are synchronized by this eccentric position signal 300.

This signal 300 is delivered to a first input terminal of an AND gate 504. A second input terminal of the AND gate 504 is connected to the output terminal of a measurement management flip/flop 506. The set and reset terminals of the flip/flop 506 are connected to respective output terminals of the microprocessor 420. An output terminal of the AND gate 504 is connected to a counter 508, and an output terminal of the counter 508 is connected to respective one and three count comparators 510,512. The output terminal of the one count comparator 510 is connected to the set terminal of a second flip/flop 516, and the output terminal of the three count comparator 512 is connected to the reset terminal of the second flip/flop 516.

The output terminals from the one and three count comparators 510,512 are also connected to respective input terminals of an OR gate 518, which has an output terminal connected to an interrupt terminal of the microprocessor 420. The output terminal of the three count comparator 512 is also connected to a reset terminal of the counter 508, and to the "OFF" terminal of a sample and hold device 514. The output terminal of the second flip/flop 516 is connected to the "ON" terminal of the sample and hold device 514. A second counter 517 has a clock input terminal connected to the microprocessor 420. A clock output terminal from the counter 517 is connected to a clock input terminal of the sample and hold device 514, and an output terminal of the sample and hold device 514 is connected to a second interrupt terminal of the microprocessor 420. In the preferred embodiment, the connections to the microprocessor 420 may be supplied through the signal conditioning circuit 408.

Operation of the eccentric position sensor 414 can be described as follows: the output terminal of the flip/flop 506 that is connected to the input terminal of the AND gate 504 is initially set to a logic "1" by a signal from the microprocessor 420. Receipt of a signal from the eccentric position transducer 242 at the other input terminal of the AND gate 504 causes a pulse to be delivered to the counter 508. The counter 517 divides the eight MHz microprocessor clock frequency by a factor sufficient to provide a data sampling rate of 6.024 KHz. This sampling frequency ensures that at least 120 points per turn of the eccentric mass 206 will be sampled at a rotation speed of 3,000 rpm. Upon the occurrence of a first pulse from the AND gate 504, the one count comparator 510 will deliver an interrupt signal via the OR gate 518 to the microprocessor 420 and will set the second flip/flop 516, which, in turn, will turn "ON" the sample and hold device 514. The sample and hold device 514 will begin accepting clock pulses from the counter 517 at the sampling rate of approximately 6 kHz.

Upon the occurrence of a third pulse from the AND gate 504, the three count comparator 512 will also deliver an interrupt pulse via the OR gate 518 to the microprocessor 420, will reset the second flip/flop 516 and turn "OFF" the sample and hold device 514, and will reset the counter 508 to "ZERO". The data accumulated in the sample and hold device 514 is representative of the time required for the eccentric mass 206 to make two complete revolutions, and is delivered to the microprocessor 420 as interrupt signals.

DESCRIPTION OF COMPUTER SOFTWARE

FIGS. 6–11 describe in flowchart form the computer software utilized in a preferred embodiment of the invention. The flowchart description is sufficiently detailed to permit one skilled in the art of computer programming to draft computer software that will implement the preferred embodiment.

The flowchart and software description can be readily divided into several principle sections for discussion purposes. These include a main program routine, shown in FIGS. *7a* and *7b*, a routine for processing sensed data in real time, shown in FIGS. 11*a* and 11*b*, and a routine for processing the data at the end of a vehicle pass, shown in FIGS. 9*a* and 9*b*. In the preferred embodiment, the main routine and end of pass routine were written in a high level technical language, for example, "C". However, the real time data processing portion of the software was written in assembly language in order to permit the fastest possible execution of the program code.

Figure 6:
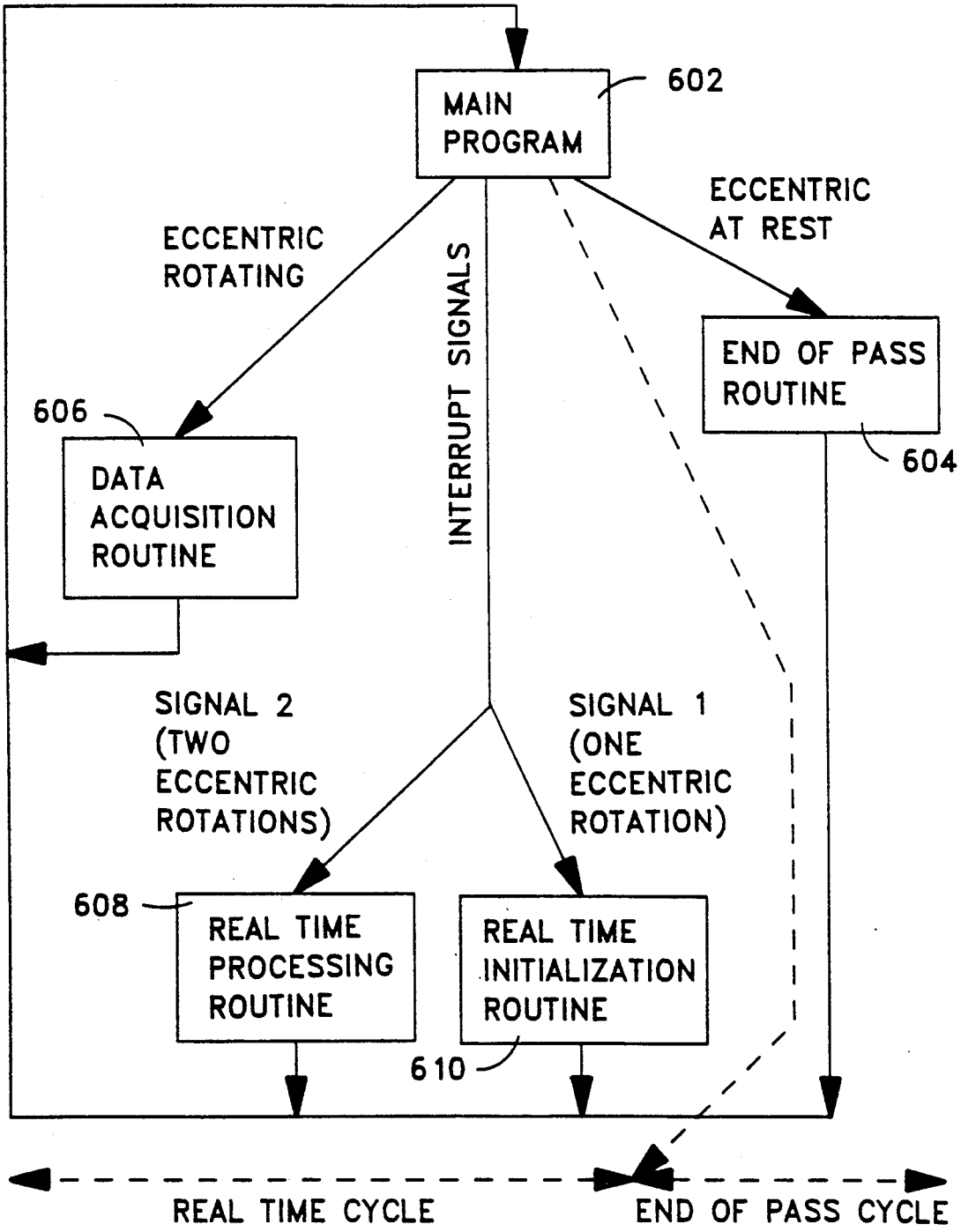
FIG. 6 is a flowchart illustrating the interrupt portion of the software program embodying the present invention.

FIG. 6 provides an overview of the entire software program, and includes software routines that are triggered by interrupts to the microprocessor 420. Beginning at block 602, the main program repeats in a loop with periodic interruptions. If the flag indicating that the eccentric mass 206 is at rest is sensed, the software proceeds to the end of pass routine at block 604 where end of pass processing occurs. When this routine has completed its activity, the program returns to the main program at the block 602.

Figure 8:
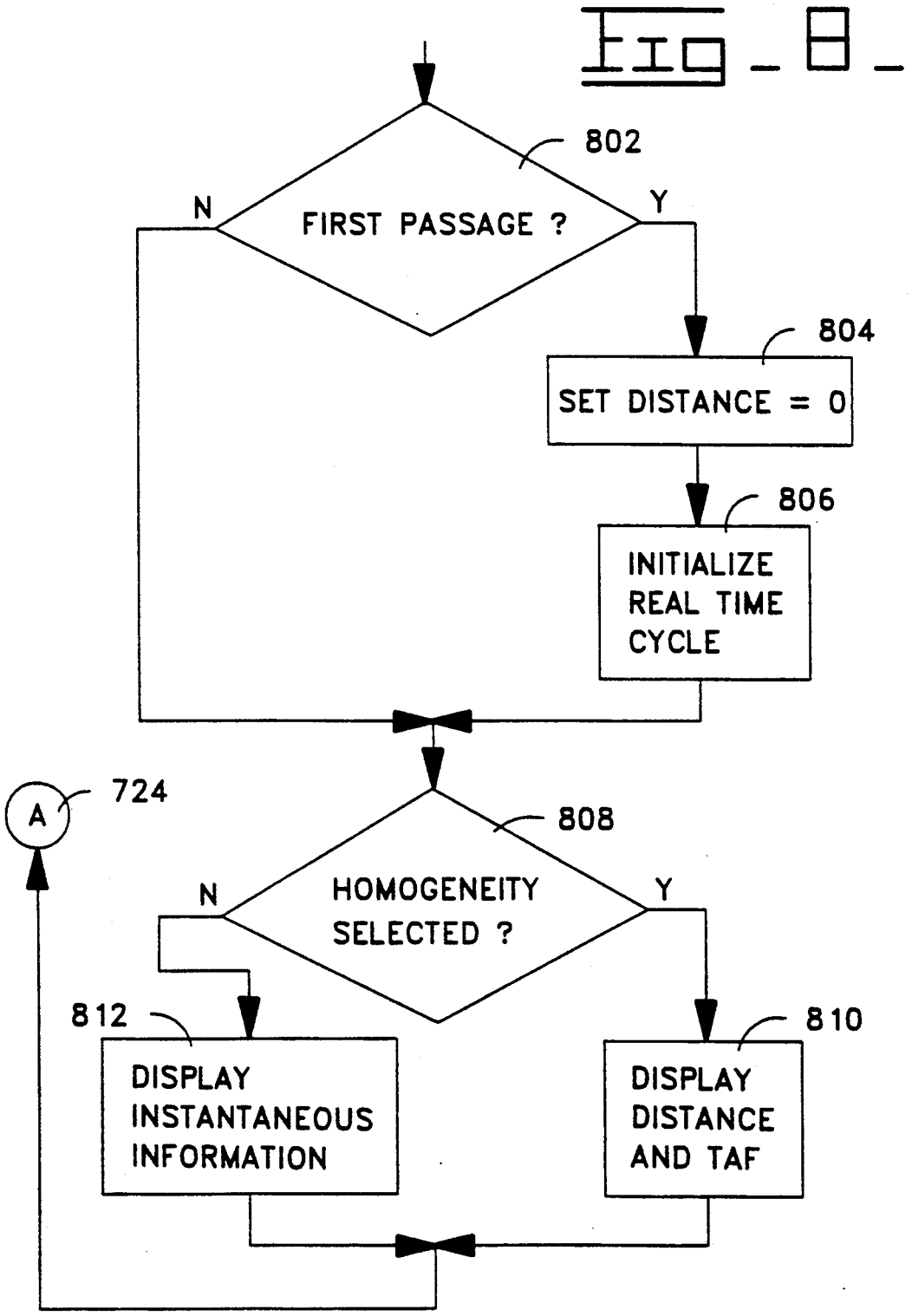
FIG. 8 is a flowchart of the real time initialization routine of the software program embodying the present invention.
Figure 11A:
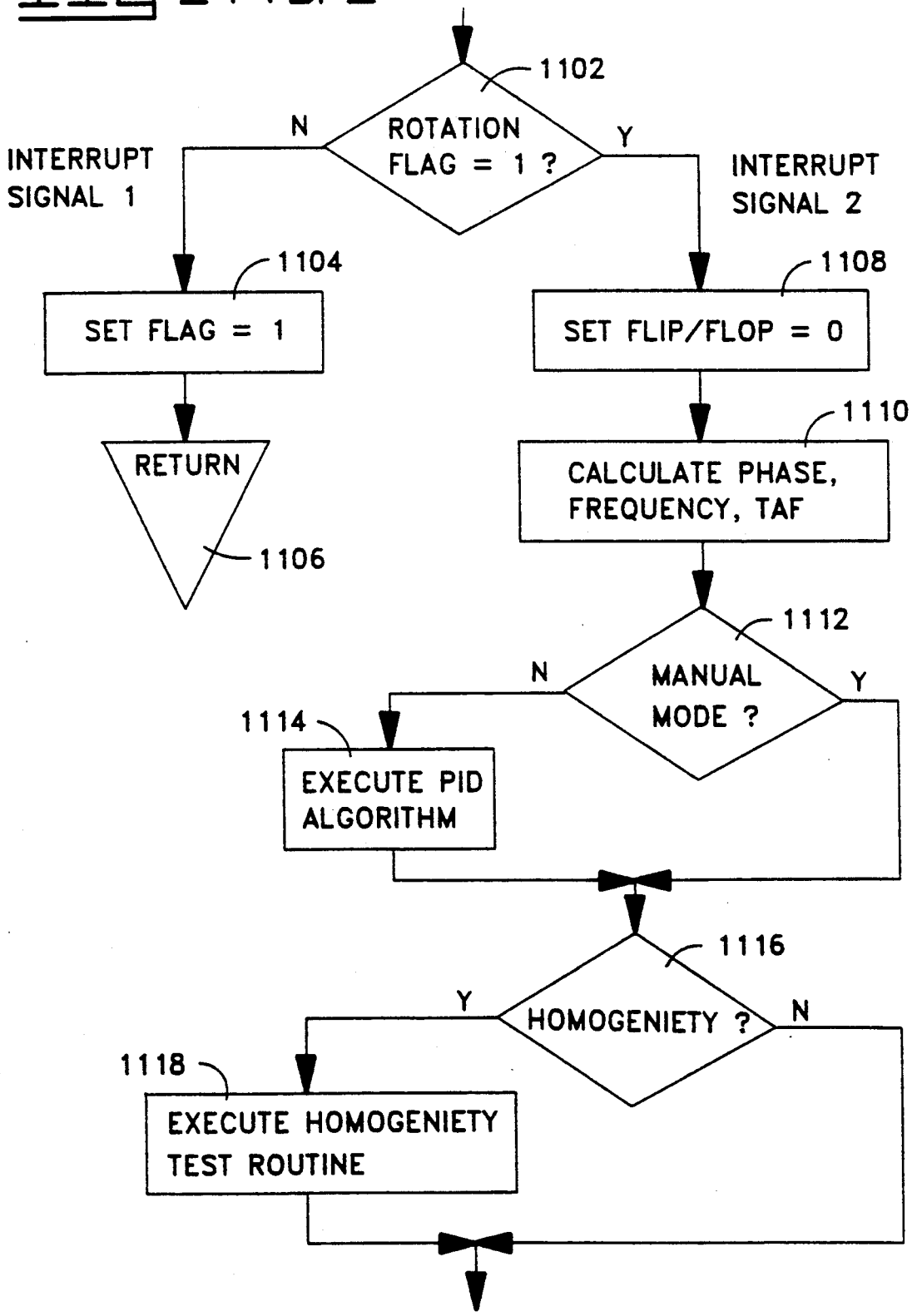
FIGS. 11*a* and 11*b* are flowcharts of the real time processing routine of the software program embodying the present invention.
Figure 11B:
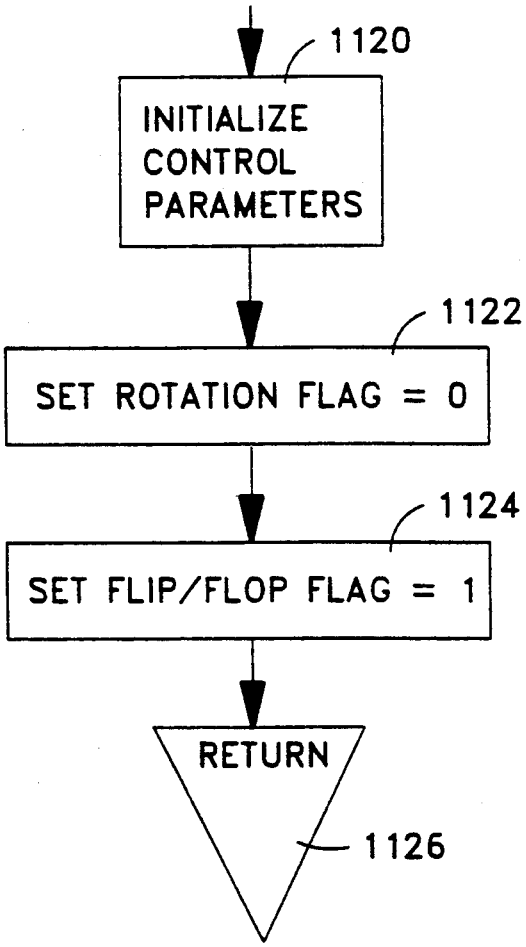

Assuming that the eccentric 206 is rotating, when a first interrupt signal produced by the one count comparator 510 is sensed by the microprocessor 420, control passes to the block 610, where the real time initialization routine described below and shown in FIG. 8, is performed. Control then returns to the program at the block 602. The first interrupt signal indicates that the eccentric mass 206 has been sensed by the transducer 242 and that data acquisition should begin. Following the first interrupt signal, each interrupt pulse from the sample and hold device 514 causes the data acquisition routine at the block 606 to be run as described below and shown in FIG. 10, after which the main program proceeds at the block 602. Upon receiving the second interrupt signal produced by the three count comparator 512, indicating that two complete revolutions of the eccentric 206 have occurred and that data acquisition is complete, processing proceeds to the block 608 where the real time processing routine shown in FIGS. 11*a* and 11*b* is executed, and then resumes at the main program in the block 602.

Figure 7A:
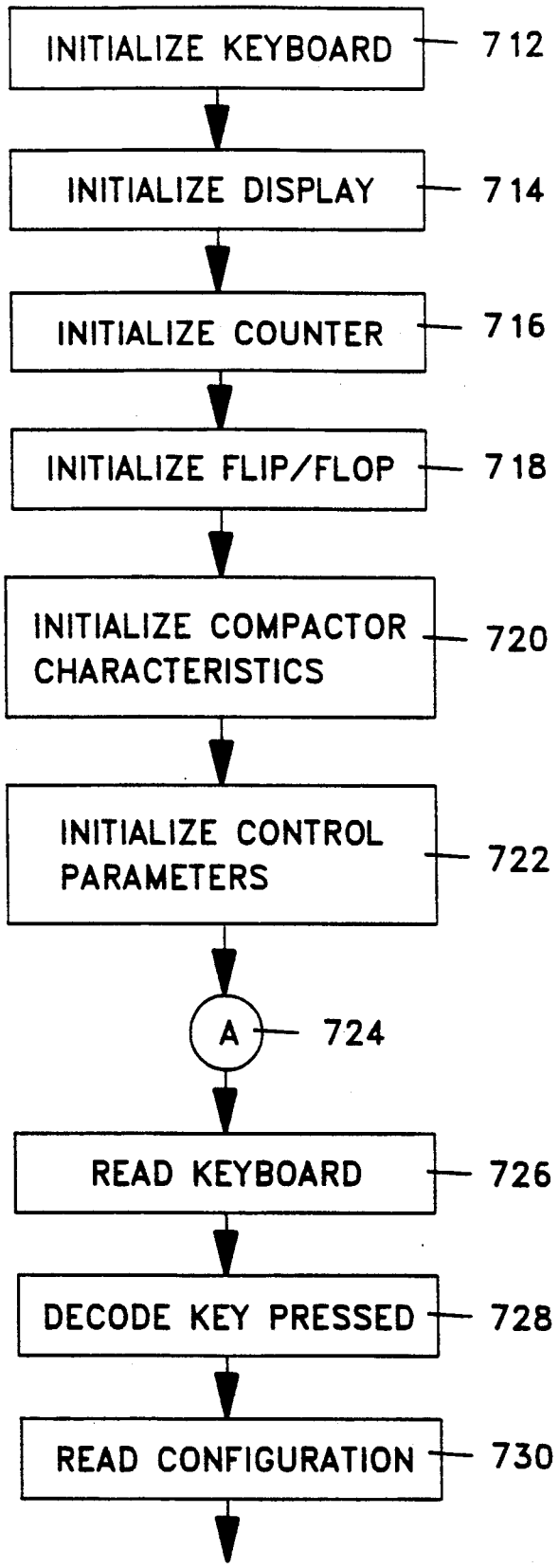
FIGS. 7*a* and 7*b* are flowcharts illustrating the main routine of the software program embodying the present invention.
Figure 7B:
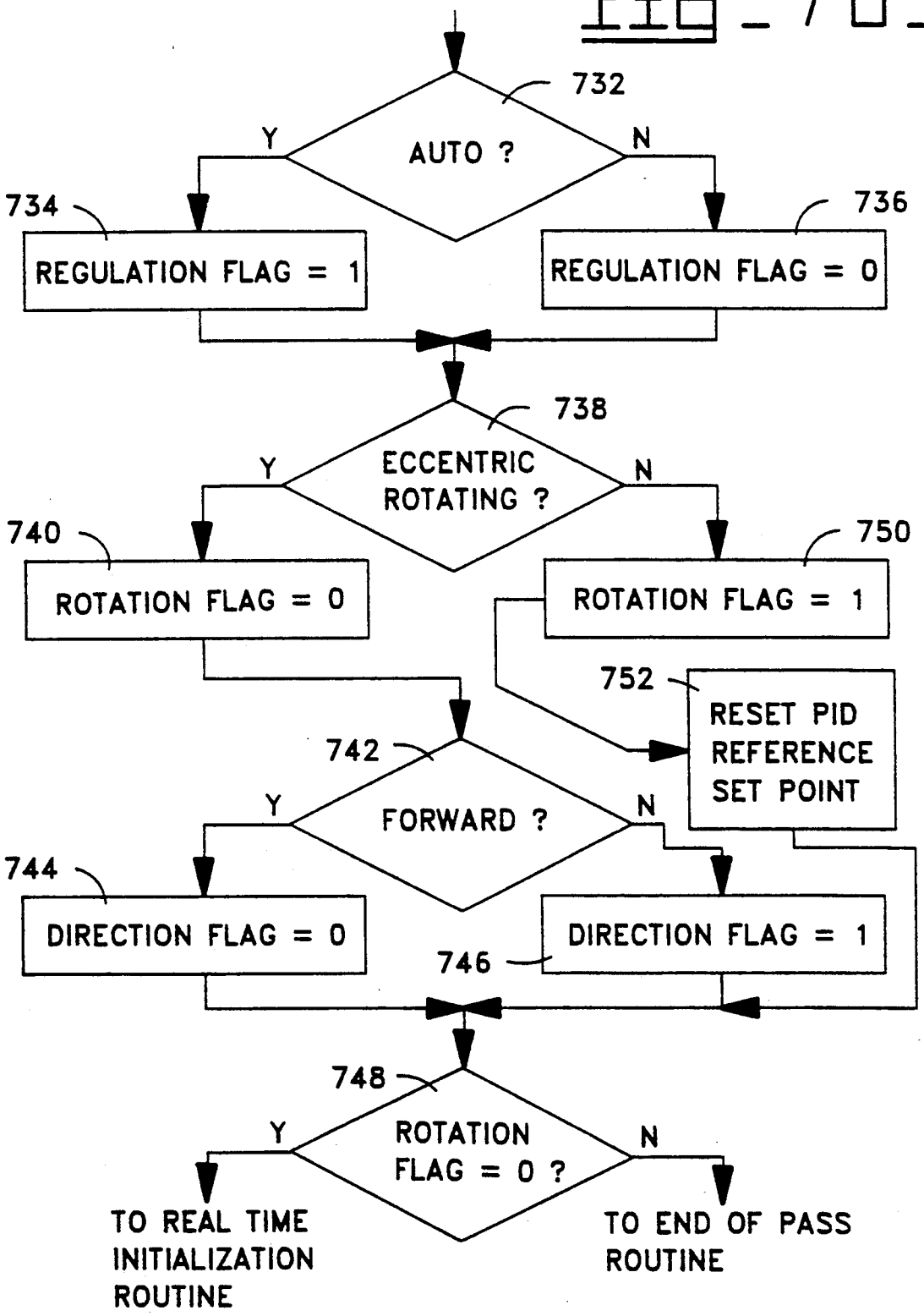

The main software routine is described in FIGS. 7*a* and *b*. The main program consists of a repeating loop which performs several different functions. These functions include initializing variables and peripherals, managing the keyboard and display devices, and controlling execution of the real time program during compaction operation and the end of pass program following compaction.

In blocks 712 through 722, a number of devices and parameters are initialized. These include the keyboard 428, display 430, flip/flop 506, and various other characteristics and parameters, including values for machine parameters such as chassis mass, drum mass and width, and the moments associated with the eccentric 206. The blocks 712 through 722 prepare the various items initialized for proper operation throughout succeeding cycles, and are only performed once during each start-up of the control system 400. The keyboard 428 may be a conventional alpha-numeric keyboard or a custom arrangement of special purpose switches. When it is desired to send a signal to the microprocessor 420, a key is pressed and decoded by the processor. Once the key has been sensed and decoded, a flag is set corresponding to the desired action. Once the action has been carried out by the processor, the flag is reset so further communications can occur.

Following initialization, the program proceeds to block 724 which is the beginning of the recurring loop portion of the program. Block 726 and 728 are used to read and decode keyboard information. At block 730, the machine configuration information is read from a register in which it is stored. This information includes the direction of travel of the vehicle, either forward or reverse, and the selection of either automatic or manual operation. If the automatic mode is selected at block 732, the regulation flag is set equal to "ONE" at block 734 while if manual operation is indicated, the regulation flag is set at "ZERO" in block 736. In either case, control passes to block 738 where it is determined if the eccentric 206 is rotating. If the eccentric 206 is rotating, a rotation flag is set equal to "ZERO" at block 740 and control passes to block 742 where the direction of travel is determined. If the vehicle is traveling in a forward direction, a direction flag is set equal to "ZERO" at the block 744. If reverse direction is indicated, the direction flag is set equal to "ONE" at the block 746. In either case, program control then passes to block 748 where the rotation flag setting is read.

If, at block 738, the eccentric 206 is found not to be rotating, control passes to block 750 where the rotation flag is set equal to "ONE" and then to block 752 where a term in a control equation discussed below is set equal to "ZERO". This term indicates the frequency of rotation of the eccentric 206, which is "ZERO" when there is no rotation. The program then proceeds to block 748 where the rotation flag is checked. If the rotation flag is equal to "ZERO", control passes to the real time initialization routine described below and shown in FIG. 8, while if the flag is not equal to "ZERO", control then passes to the end of pass software routine shown in FIGS. 9*a* and 9*b*.

The information contained in the configuration register which is decoded at blocks 730 through 750 provides various information needed by the control system 400. For example, in the event that the manual mode is selected the software continues to take measurements from the accelerometers 210,230, but does not exercise control of the vehicle. If the automatic mode is selected, the software not only takes the measurements, but also controls the frequency of eccentric rotation. The machine characteristics, in particular, the arrangement of the drive elements, influence the distribution of forces, e.g., torque, applied by the machine to the ground. Therefore, the indicated direction of travel influences the calculations that are performed by the control system 400.

The real time initialization routine is described in FIG. 8. The program first checks, at block 802, whether the real time initialization routine is being run for the first time during any one pass of the vehicle over the ground. If the answer is yes, the register in which distance readings are stored is set equal to "ZERO" in the block 804 and the real time cycle is initialized in the block 806. The program then passes to block 808. If this is not the first time through this routine during a particular vehicle pass, control proceeds directly to block 808.

At block 808, the program determines whether the homogeneity function described below has been selected. If so, the program proceeds to block 810 where distance and TAF (total applied force) values are displayed. If the homogeneity function has not been selected, control passes to block 812 where information determined by the control system 400 and further described below, including TAF, frequency $\omega$, and phase angle $\phi$ and phase angle $\phi$ reference data, is instead displayed. In either case, control then proceeds back to block 724 where the loop is again performed.

Figure 9A:
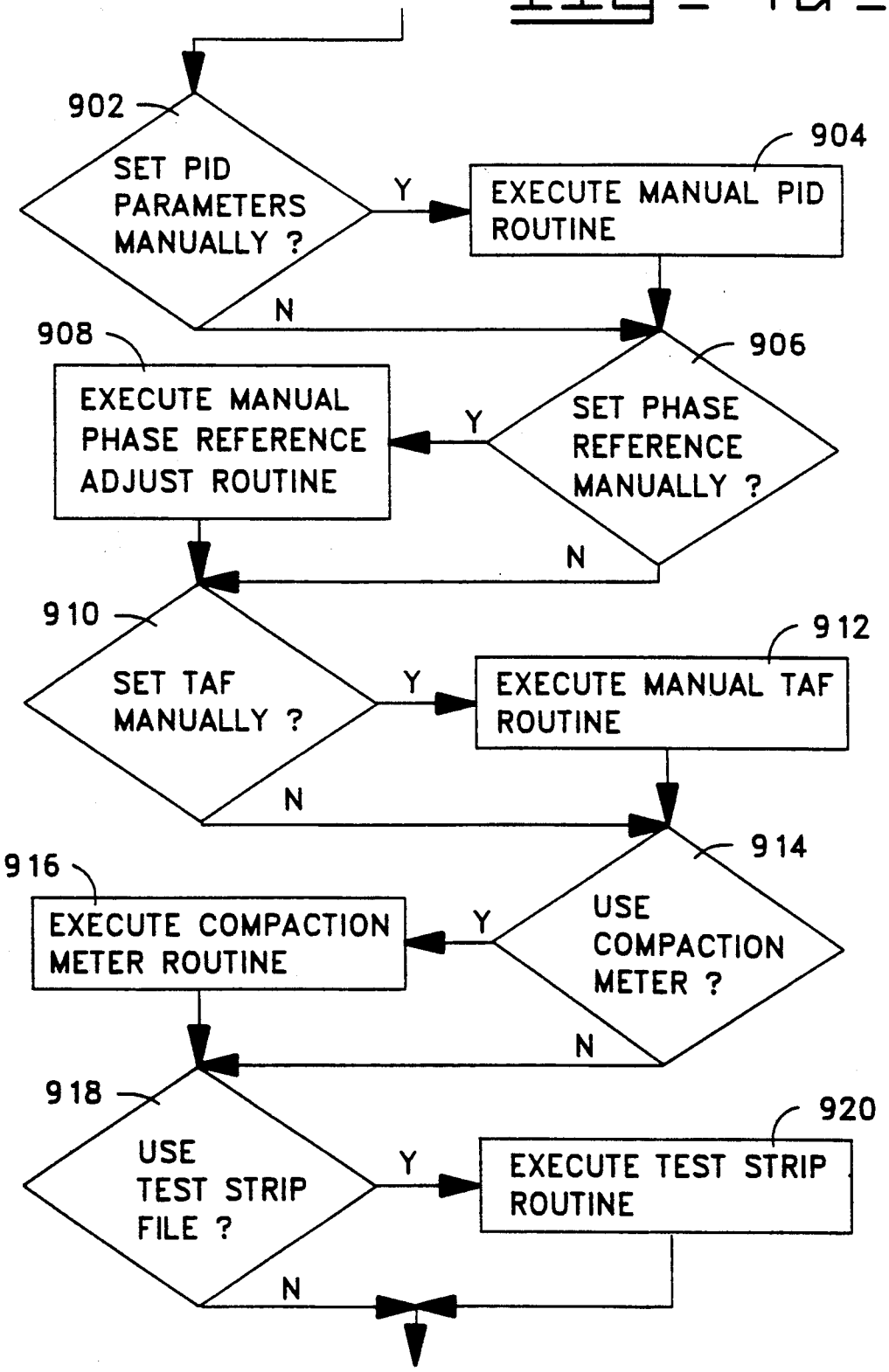
FIGS. 9*a* and 9*b* are flowcharts describing the end of pass routine of the software program embodying the present invention.
Figure 9B:
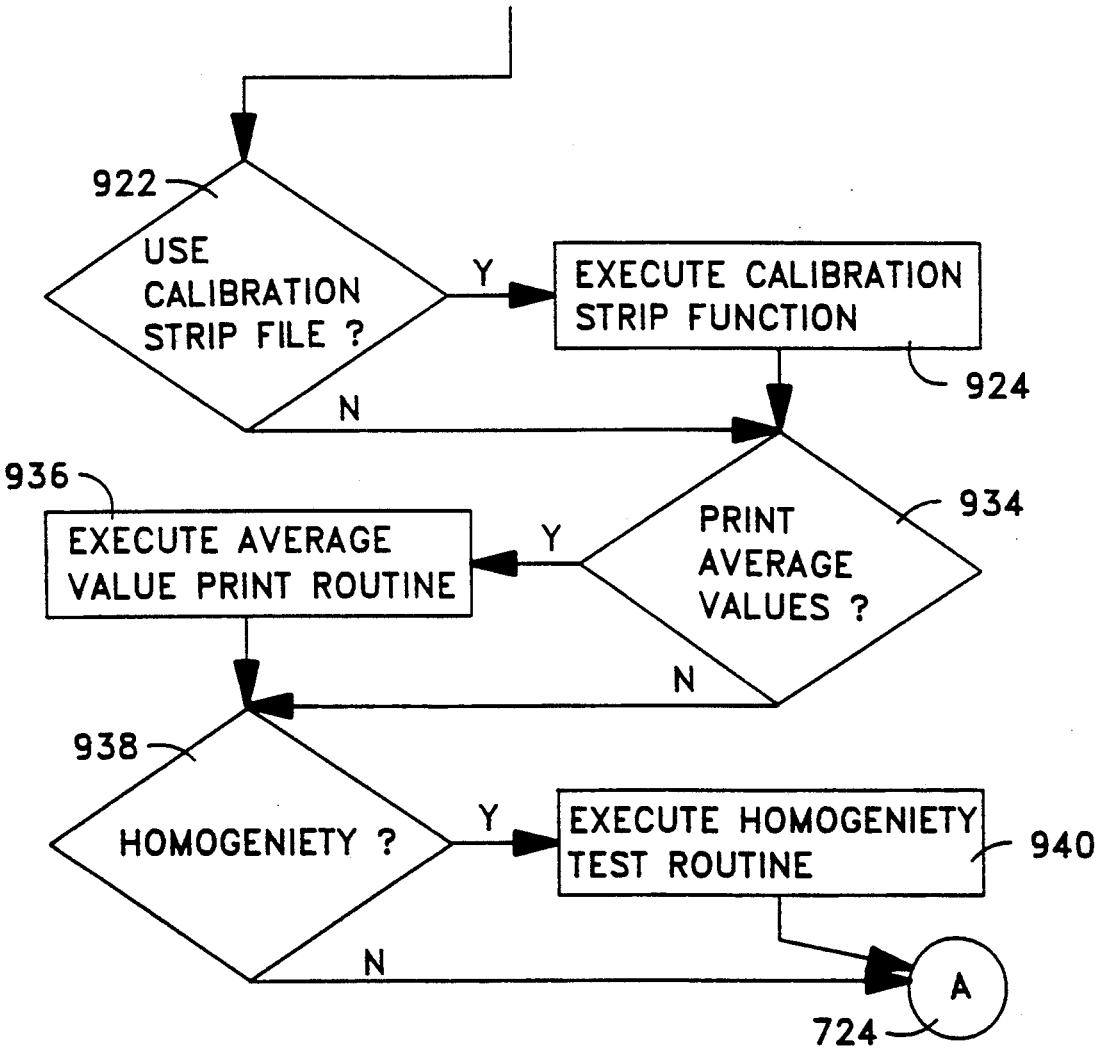
Figure 10:
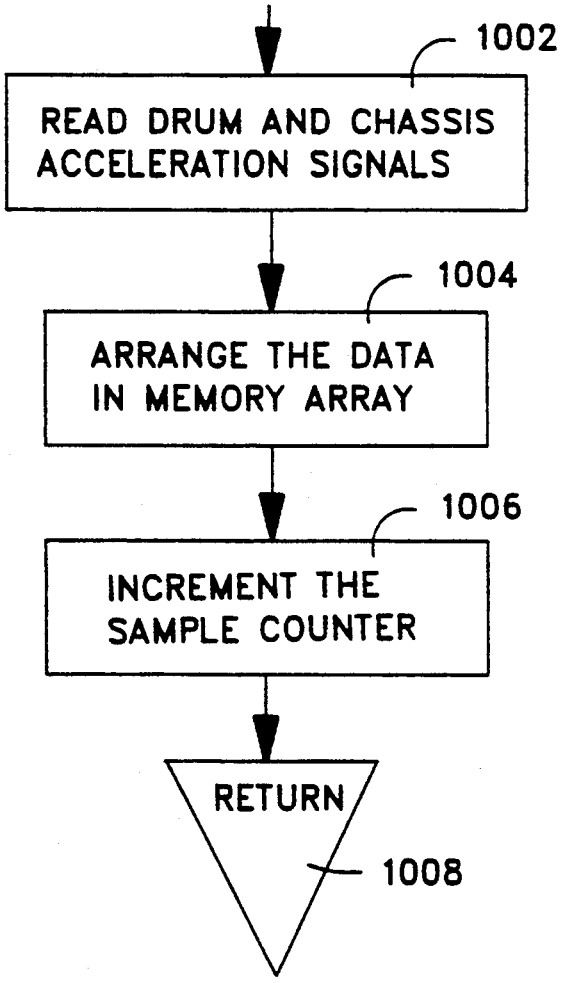
FIG. 10 is a flowchart of the data acquisition routine of the software program embodying the present invention.

FIGS. 9*a* and 9*b* describe the end of pass software routine. Upon detection of the end of pass signal, a number of routines are optionally performed in accordance with selections made on the system keyboard 428. Three general categories of functions are involved: those relating to manual initialization of various set points, those relating to use of the control system 400 as a compaction meter, i.e., as a meter to evaluate the density of compacted material, and the display of end of pass average values and phase angle $\phi$ set point values.

At block 902 it is determined if the proportional/integral/derivative (PID) value used in later calculations are to be manually adjusted. If so, at block 904 the manual PID routine is executed and the present PID proportional gain value is displayed. The operator is permitted to either accept this value or modify it. In like manner, the integration and derivative time constants are displayed sequentially for the operator's review and/or modification.

The program then proceeds to block 906 where it is determined whether the set point of the phase angle reference, should be manually adjusted. If so, at block 908 the phase adjust routine is performed. Both the forward and reverse phase reference set points are displayed for the operator, who can either accept the displayed values or modify them. If a phase angle reference set point value less than zero or greater than 360° is selected, the operator is re-prompted to enter a value between these limits. As is known in the art, it is desirable to maintain a phase angle relationship between the eccentric mass 206 and the drum 102 in a range between about 90° to 120° to maintain the vibratory motion of the material contacting member at the resonant frequency. In the preferred embodiment, the phase angle $\phi$ is established at 105°.

Program control then proceeds to block 910 where the determination is made whether the total applied force (TAF) reference set points should be modified. If so, at block 912 the total applied force reference adjustment routine is run. In a manner similar to the adjustment at block 906 to the phase angle reference, the operator is prompted with the presently stored values for both forward and reverse total applied force reference set points and may change these as desired. Again, a magnitude test is performed to ensure that the selected total applied force reference set points are within a reasonable range.

The next inquiry, at block 914, relates to whether or not the compaction meter function is desired. If so, the compaction meter routine is run at block 916. The compaction meter routine is utilized to calculate the average total applied force at the end of each pass of the vehicle over the material to be compacted. This average force is compared to the total applied force reference set point, and if the calculated force equals or exceeds the set point, the soil density requirement has been attained. The routine at block 916 displays the set point and measured total applied force values in the appropriate one of the forward or reverse direction and displays an end-of-compaction message if the total applied force equals or exceeds the set point.

Control then proceeds to block 918 where it is determined whether a test strip file should be utilized. If so, at block 920 the test strip routine is executed. This routine is described below, and serves to accumulate data in a non-volatile memory area.

In executing the test strip routine at block 920, the operator must first confirm that any existing test strip files should be overwritten by new data. Assuming that this is done, the system accepts new measurements. At the end of each pass, when the eccentric mass is at rest, the direction of travel, the pass number, and the average total applied force during the pass are displayed and stored in memory. This procedure continues until the operator indicates that the test strip file should be closed and that the process is completed.

Program control then proceeds to block 922 where it is determined whether a calibration strip file should be utilized instead of a test strip file. The calibration strip file also described below, and is normally used for small job sites where laboratory testing of material density would be too expensive and would take too much time. The information relating to the calibration strip file is accumulated at the block 924 in a manner similar to that described above for the test strip and is stored in a table in the same manner.

The program prompts the operator to enter information relating to whether the test strip or calibration file should be utilized and requires that the number of necessary passes be provided if the test strip routine is selected. If the calibration method is chosen by the operator, he must supply both forward and reverse total applied force percentage variation thresholds to the system. The computer then calculates the total applied force reference set points in both the forward and reverse travel directions as described below, and displays the results to the operator. These values are stored in the protected memory area.

Control then passes to block 934 where it is determined whether average values are to be provided to a RS232 output port connected to the microprocessor 420 at the end of a pass. If so, at block 936 the routine is run to transmit values for TAF, phase angle $\phi$, drum and chassis acceleration, eccentric frequency $\omega$, and, optionally, the test and calibration strip files.

Finally, at block 938 it is determined whether a homogeneity test, as described below, is to be performed. If so, this test is run at block 940 after which program control loops back to block 724.

When the first interrupt signal is received from the one count comparator 510, the sample and hold device 514 begins accepting clock pulses from the counter 517. Each clock pulse generates an interrupt to the microprocessor 420, which causes the main program to be suspended while the data acquisition routine is run. This is described in FIG. 10, where the routine reads the analog to digital converter outputs from the drum and chassis accelerometers 210,230 and places the values in an array in memory. At block 1002 the signals are read into the microprocessor 420, and at block 1004 the data is appropriately arranged in memory.

A single complete reading of the accelerometer values requires two successive readings of the data, because the A/D convertors 405,406 each provide 12 bit precision output signals and the microprocessor 420 can only accept one 16 bit data word at a time. Therefore, during a first microcomputer read cycle, the 8 least significant bits from the drum accelerometer A/D convertor 405 are received and stored in a computer register as the 8 least significant bits of the data word, and the 8 least significant bits from the chassis accelerometer A/D convertor 406 are read and stored as the 8 most significant bits of the data word. On the next microprocessor cycle, the 4 most significant bits from the drum A/D convertor 405 are stored as the least significant bits of a data word in a second computer register, and the next four bits of the data word are padded with "ZEROS". The 4 most significant bits of the chassis A/D convertor 406 are then stored as the next four bits of the data word, followed by four more bits of padding, producing a second 16 bit data word.

The computer registers therefore contain respective data words arranged in the form "cccccccddddddddd" followed by "0000CCCC0000DDDD". These data are then stored in respective 16 bit drum and chassis memory arrays by reassembling the data in the form "0000DDDDdddddddd" and "0000CCCCcccccccc". Therefore, taken together, the two successive readings produce two 16 bit words representing simultaneous chassis and drum acceleration values. Following the reading and storing of the data, control passes to block 1006 where the sample counter is incremented, and then to block 1008 which terminates the interrupt program and returns execution to the main program at the same point at which interruption occurred. The data acquisition routine is run each time an interrupt is generated by the sample and hold device 514, until the second interrupt signal is received by the microprocessor 420 from the three count comparator 512, indicating that two complete revolutions of the eccentric 206 have occurred. At this time, the two memory arrays contain a series of acceleration values for a complete data acquisition period.

The measurement process is shown graphically in FIG. 3, where the signal 300 includes pulses produced once each revolution by the eccentric 206. The first pulse in the signal 306 allows the clock signals to be accepted by the sample and hold device 514. Each clock pulse generates an interrupt during the data acquisition portion of the curve 308. Completion of two eccentric cycles ends the data acquisition time period, and begins the real time processing portion of the curve 310. These alternating time periods continue as long as the control system 400 continues to accumulate data during a pass of the vehicle over the material 10 to be compacted.

The real time processing routine shown in FIG. 11*a,b* is initiated by an interrupt generated by the rotation of the eccentric mass 206 and produced by the three count comparator 512. At block 1102 a rotation flag is checked to determine whether it is equal to "ONE". If not, the flag is set to "ONE" at block 1104 and the routine terminates at block 1106, returning control to the main program. This indicates that data acquisition is still underway and that no processing of the data should yet occur. At the end of two rotations of the eccentric mass 206, the test at block 1102 will show that the rotation flag has been set to a value of "ONE" and that the data acquisition cycle is complete. This causes the flip/-flop 506 to be reset to "ZERO" at block 1108, completing the acquisition cycle and beginning the real time processing of the data.

The chassis and drum acceleration data files are processed separately. Total applied force data taken over consecutive eccentric mass rotation cycles may vary somewhat, but variations become negligible when two successive cycles are combined. At block 1110, and as described more fully below, the data is processed separately and then averaged. Calculations relating to phase angle $\phi$, frequency $\omega$, and total applied force TAF are performed.

At block 1112, it is determined whether the manual mode has been selected. If not, control proceeds to block 1114 where the PID algorithm is executed. The PID algorithm calculates a control signal utilizing the previous phase angle measurement as a starting point. The algorithm is designed to maintain equality between the measured and set point phase angles. The error derived from the PID algorithm is sent as a control signal through the D/A converter 422 to control the servo valve 426, which, in turn, controls the speed of rotation of the eccentric mass 206.

Control then passes to block 1116 where it is determined whether or not the homogeneity test is required. If so, the homogeneity procedure is executed at block 1118. In this routine, data from thirty eccentric mass rotational cycles are accumulated, representing roughly two meters of vehicle travel. The total applied force value is averaged over the thirty cycles, and the precise distance covered by the vehicle is measured by the distance sensor 412 and accumulated by the microprocessor 420. These two data are stored in a table, and can be used to trace the total applied force in steps of roughly two meters each. This will give the operator an indication of the homogenous nature of the compaction being attained.

Following this procedure, or if the function is not desired, control proceeds to block 1120 where control parameters are initialized. In particular, the rotation flag is set to "ZERO" at block 1122, and the flip/flop 506 is set to "ONE" at block 1124. This permits the measurement cycle 308 to repeat upon the next occurrence of a first interrupt signal. Following this reinitialization, the program proceeds to block 1126 which concludes the routine, and the main program proceeds from the point at which it was interrupted.

If the manual mode is selected at block 1112, the PID algorithm at block 1114 is not executed, program control passes directly to the homogeneity test at block 1116, and proceeds as discussed above.

CALCULATION OF THE PHASE ANGLE, FREQUENCY AND TAF

The sum of all internal and external forces applied on the drum 102 must equal zero. Therefore, the upwardly vertical reactive force applied by the material 10 to the drum, or material contacting member 102, must equal the sum of the downwardly vertical forces applied by the drum to the compactible material. This downwardly vertical force is the compacting force applied by the vibrating tool, or drum 102, to the compactible material 10, and is identified herein as "TAF", the total applied force. The total applied force, TAF, is calculated as described below. Also, the terms "vertical" and "vertically", as used herein, mean a direction perpendicular to the ground surface.

As described above, the values of the vertical acceleration of the drum, $F_{vd}$, and of the chassis, $F_{vc}$, are recorded for each clock count during two (2) consecutive rotations of the eccentric mass 106. During the third rotation, the maximum value of the drum acceleration, $F_{vd}$, occurring during each of the two preceding rotation periods is determined. For purposes of the following description, the maximum positive values of the drum acceleration, i.e., the maximum value of acceleration in the upwardly vertically direction, sensed during the two consecutive periods are identified as $F_{vd1}$ and $F_{vd2}$. The corresponding values of the chassis acceleration, i.e., the value of the chassis acceleration at the time the drum acceleration is at a maximum value, are designated $F_{vc1}$ and $F_{vc2}$.

The angular displacement of the eccentric mass 206, i.e., the radial angle traversed by the eccentric mass from the sensed position to the position of the eccentric mass 206 at the time the vertical acceleration of the drum $F_{vd}$ has a maximum value, is designated as the phase angle, $\phi$. The phase angles for each of the two measured eccentric mass rotation cycles are designated $\phi_1$ and $\phi_2$ respectively, and are calculated according to the following formula:

$$\phi_1 = \frac{360^\circ \times R_1}{n_1}$$

and $$\phi_2 = \frac{360^\circ \times R_2}{n_2},$$

where $R_1$ and $R_2$ are the clock counts at which the maximum drum acceleration values $F_{vd1}$ and $F_{vd2}$ respectively occur, and $n_1$ and $n_2$ are the total number of clock counts occurring during the rotation of the eccentric mass through each respective 360° rotary cycle.

The frequency, $\omega$, of the rotating eccentric mass 206, is calculated by averaging the frequency during the two consecutive eccentric mass rotational cycles, i.e.,:

$$\omega = \frac{\text{Clock Frequency} \times 2}{n_1 + n_2}$$

where the clock frequency is the frequency of the signal provided by the counter 517, and $n_1$ and $n_2$ are, as above, the total number of clock counts measured during each respective rotation of the eccentric mass through one 360° revolution.

The maximum acceleration values of the drum, $F_{vd1}$ and $F_{vd2}$, during the two consecutive rotation cycles, and the corresponding acceleration values of the chassis, $F_{vc1}$ and $F_{vc2}$ are also averaged. Therefore, the values of $F_{vd}$ and $F_{vc}$ represent an average value of these parameters for two rotational cycles of the eccentric mass 206.

Calculation of TAF, the total force applied by the drum 102 to the compactible material 10 is carried out by adding the static force, the dynamic force, and the vertical vectorial component of the centrifugal force. The static force is:

$$\textit{Static Force} = M_v \times g.$$

where $M_v$ is the respective mass of the vehicle in contact with the ground, and g is the gravitational constant, (9.81 m/s$^2$).

The dynamic force component of the total applied force is determined by the following formula:

$$\textit{Dynamic Force} = (M_d \times F_{vd}) + (M_c \times F_{vc}).$$

where $M_d$ is the mass of the drum 102, and $M_c$ is the mass of the chassis 106. The mass of the chassis $M_c$ is the respective mass of the vehicle, $M_v$, minus the mass of the drum $M_d$, i.e., $M_c = M_v - M_d$.

In some vehicle arrangements the chassis dynamic force is sufficiently negligible that, for the purpose of this patent application, "total applied force" (TAF) shall mean the total of the force components as set forth herein, either with or without the chassis dynamic force component.

The total centrifugal force, $F_c$, of the rotating eccentric member 206 is:

$$F_c = M_e \times r \times \omega^2.$$

where $M_e$ is the mass of the eccentric member 206, and r is the radius of rotation of the gravitational center of the eccentric member 206 from the center of rotation $\alpha$.

The centrifugal force component contributing to total applied force, TAF, is the vertical vectorial component of the total centrifugal force $F_c$, and is calculated as follows:

$$\textit{Centrifugal Force} = F_c \times \cos \phi.$$

Therefore TAF, the total force applied vertically by the ground contacting member 102 to the compactible material 10 is represented by either of the following formulas, a or b:

$$TAF = (M_v \times g) + (M_d \times F_{vd}) + (M_c \times F_{vc}) + (F_c \times \cos \phi) \quad \text{(a)}$$

or, (if the chassis dynamic force is negligible);

$$TAF = (M_v \times g) + (M_d \times F_{vd}) + (F_c \times \cos \phi). \quad \text{(b)}$$

In summary, the total force applied to a compactible material by a vibratory tool is determined by measuring the vertical acceleration of the material contacting member and, if of significant value, the vertical acceleration of the chassis upon which the material contacting member is mounted. Calculation of the dynamic and centrifugal forces is made when the material contacting member, or drum, is at its lowest position. This corresponds to the time at which the most force is being applied to the ground by the drum and accordingly is the time at which the drum has a maximum acceleration value. Data are acquired during two consecutive cycles of rotation of the eccentric mass 206, and calculation of the total applied force, i.e., the vectorial sum of the static, dynamic and centrifugal forces applied in the vertical direction, is made for each cycle and averaged. This provides a value representing the total applied force for every three rotations of the eccentric mass 206.

INDUSTRIAL APPLICABILITY

As shown above, in the chart shown under Background Art, the parameter having the most sensitivity to soil density is total applied force (TAF). The TAF value is particularly sensitive to small incremental increases in material density as the density increases to its maximum, or fully compacted value. Also, as can be seen, the calculation of the TAF values takes into account the vehicle operating parameters, such as mass and frequency of rotation of the eccentric mass 206, and thereby permits comparison between sets of values obtained under operating conditions during which these parameters are varied.

Also, as described in the discussion of the software program, the total applied force values can be advantageously used in a number of ways. In one method, two test strips having the same material composition are prepared. Compaction of the first strip is stopped after every few passes to measure, by laboratory methods, the density of the material, and a record is made of the relationship between density and the number of passes. On the second test strip, continuous passes are made over the material in both the forward and reverse directions. At the end of each pass, the average value of the total applied force per unit length of the drum (TAF/L) is recorded in separate files for the forward and reverse directions of the pass.

After acquisition of data for both of the test strips is complete, the data are entered into the computer memory to provide a calibrated reference between material density, number of passes and TAF/L values. It can then be determined the number of passes required to obtain the compaction quality, e.g., 100% of Proctor reference, in 12 passes. After entering this information, the system is ready to use as a compaction meter. During subsequent compaction of the tested material, TAF is continuously calculated. At the end of each pass the average TAF/L value is determined and compared with the previously determined reference value required to achieve the desired material density. Compaction is then carried out until the measured value equals or exceeds the reference value, at which point a message "End of Compaction" is shown on the display 430.

In another method of use, passes are made in the forward and reverse direction over a defined work area to establish a calibration strip file. At the end of each pass, average TAF values are calculated and stored in separate files corresponding to the forward and reverse passes. At the end of this process, a calculation is made of the rate of change of TAF for successive passes of the compactor. A reference value of the TAF relative differential determines the economic limit of the number of passes, e.g., 1% of TAF increase between two consecutive passes. This reference value is stored in the computer memory. When the TAF relative differential for consecutive passes corresponds to the reference value, compaction of the defined work area is stopped.

In yet another method of use, the homogeneity of a previously compacted material can be evaluated. For this function, a compactor 100 having the control system 400 is operated in a forward direction at a constant speed. The position of the compactor 100 with respect to a reference ground position is provided by a distance measuring sensor 412. The average TAF value is calculated for small segments of the material surface, e.g., two meter lengths, recorded in memory, and compared with a reference TAF value. This data may then be printed or otherwise transferred to a display device. Thus, areas that do not conform to the desired compaction quality can be identified and corrected.

Furthermore, optimum vehicle ground speed may be determined by dividing the vehicle speed by the number of passes required to produce a desired TAF value. The operational efficiency of the vehicle is greatest when this ratio has a maximum value.

All of the above methods of use can be carried out in a mode in which the frequency and mass of the eccentrically mounted member 206 are maintained at constant values, or selectively varied to improve compactor efficiency. If varied, the frequency can be controlled either manually by the operator or automatically by the control system 400. If a variable mass is utilized, appropriate sensors can measure the effective mass and resultant radial position of the mass, and provide these values to the control system 400.

Additionally, the calculated values of the above parameters relating to phase angle, frequency and TAF can be recorded for evaluation of machine and production performance when combined with other production parameters such as operating hours, fuel consumption, and distance traveled. For example, the total applied force values can be analyzed statistically to determine a dispersion value of the TAF. This can provide valuable quality control parameters. The cost per ton of compacted material can also be advantageously determined.

If the control system includes an RS232 or similar data transfer connection, the recorded information can be made available to external devices for analysis. A radio or similar link can also be provided to the control system.

Other aspects, objects and advantages of this invention can be obtained from a study of the drawings, the disclosure, and the appended claims.

We claim:

1. A method for controlling a vibratory tool for moving over and compacting compactible material, said vibratory tool having a member eccentrically attached to a rotatable shaft, said eccentrically attached member having a mass and said tool being mounted on a chassis, comprising:

moving the vibrating tool over the compactible material and maintaining said tool in substantive rolling contact with said material during moving;

rotating said eccentrically attached member simultaneously with moving said vibrating tool;

sensing the vertical acceleration of said vibrating tool and producing signals corresponding to the magnitude and direction of said vertical acceleration;

determining the maximum positive value of the vertical acceleration signals during one rotation of said eccentric member;

sensing the presence of the rotating eccentric mass at a predetermined reference position;

calculating the angular position of said rotating eccentric mass responsive to the determined maximum positive value vertical acceleration signal;

delivering said determined maximum positive value vertical acceleration signal;

comparing said calculated angular position of the eccentric member with said predetermined position and producing a signal representative of the angular displacement between said calculated angular position and said predetermined reference position;

producing signals representative of the mass of said chassis, said vibrating tool and said eccentrically mounted member;

producing a signal representative of the distance between the center of gravity of said eccentrically attached member and the center of rotation of said shaft;

producing a signal representative of the rotational frequency of said eccentrically mounted member;

receiving said signals corresponding to the maximum positive value of the acceleration of said vibrating tool, the angular displacement of said eccentrically attached member, the mass of said chassis, said vibrating tool and said eccentrically attached member, and the distance and rotational frequency of said eccentrically attached member;

calculating the static, dynamic and centrifugal forces applied by said vibrating tool to the compactible material;

summing said calculated static, dynamic and centrifugal forces applied by said vibrating tool to said compactible material;

delivering a signal responsive to said summing; and stopping the movement of said vibrating tool over the compactible material when said summing signal has a predetermined value.

2. A method for controlling a vibratory tool, as set forth in claim 1, including the steps sensing vertical acceleration of said chassis when the vertical acceleration of the vibrating tool is at said maximum value and receiving said vertical acceleration signal prior to calculating the static, dynamic and centrifugal forces applied by said vibrating to the compactible material.

3. A method for controlling a vibratory tool, as set forth in claim 1, including the step of controlling the rotational frequency of the eccentrically mounted member and maintaining a resonant relationship between said vibratory tool and the compactible material.

4. A method for controlling a vibratory tool, as set forth in claim 1, including the step of producing a visual display representative of said summed signal;

5. A method for controlling a vibratory tool, as set forth in claim 1, including the step of comparing the value of said summed signal with a preselected value, and producing a visual display representative of the compared values.

6. A method for controlling a vibratory tool, as set forth in claim 1, including the steps of:

recording a plurality of said summed signals during a selected compacting operation;

storing said recorded summed signals;

comparing a last measured summed signals with a selected stored summed signal; and producing a signal responsive to the difference between said last measured summed signal and said selected summed signal.

7. A method for controlling a vibratory tool, as set forth in claim 1, including the step of determining the direction of rotation of said material contacting member and producing a signal corresponding to said direction of rotation.

8. A method for controlling a vibratory tool, as set forth in claim 1, wherein the steps of sensing the vertical acceleration of said vibrating tool, determining the maximum positive value of the vertical acceleration of said vibrating tool, sensing the presence of the rotating eccentric mass, calculating the angular position of said rotating eccentric mass, comparing said calculated angular position with a predetermined position and producing an angular displacement signal, and producing a signal corresponding to the vertical acceleration of said chassis, are carried out for two consecutive rotation cycles of said eccentric mass and averaged.

9. In an apparatus for controlling a vibratory tool having a chassis, a material contacting member resiliently and rotatably mounted on the chassis, a shaft rotatably mounted on the material contacting member, a member eccentrically attached to the rotatably mounted shaft, and a means for rotating the shaft includes a means for sensing vibratory motion of the material contacting member and producing a signal corresponding to said vibratory motion, and a means for determining the angular position of the eccentrically attached member relative to a preselected position when the vibratory motion of said material contacting member is at a maximum value and producing a signal corresponding to said relative angular position, the improvement comprising:

means for delivering a plurality of set point signals each representative of a respective mass of said chassis, mass of said material contacting member, mass of said eccentrically attached member, and distance from the center of gravity of the eccentrically attached member to the center of rotation of said shaft;

means for sensing the rotational frequency of the eccentrically attached member, developing a signal in response thereto, and delivering said developed signal;

means for receiving said set point signals and said rotational frequency signal, calculating the static, dynamic, and centrifugal forces of said material contacting member, summing the value of said calculated forces, and delivering a signal responsive to said summed calculated forces;

comparing said summed calculated forces signal to a predetermined set point value; and delivering a signal for stopping movement of said vibratory tool in response to the comparison of said summed calculated forces signal being at a predetermined magnitude.

10. An apparatus, as set forth in claim 9, including means for sensing the vibratory motion of said chassis, developing a signal in response to said sensed motion and delivering said developed signal.

11. An apparatus, as set forth in claim 9, including means for controlling the rotational frequency of the eccentrically mounted rotating mass.

12. An apparatus, as set forth in claim 9, wherein said summed calculated forces signal is a visual signal.

13. An apparatus, as set forth in claim 9, wherein the stopping signal is a visual signal.

14. An apparatus, as set forth in claim 9, including means for recording a plurality of preselected summed calculated forces signals over a preselected period;

means for delivering at least one of said recorded preselected summed calculated forces signals (S), comparing said at least one signal (S) to the last summed calculated forces signal of the preselected period; and delivering an output signal responsive to the difference resulting from said comparison.

15. An apparatus, as set forth in claim 9, including means for determining the direction of rotation of said material contacting member and producing a signal corresponding to said direction of rotation.

* * * * *